US011066824B2

(12) United States Patent
Hansort

(10) Patent No.: US 11,066,824 B2
(45) Date of Patent: Jul. 20, 2021

(54) GROUND ANCHOR BRACKET WITH SIMULATED SLAB SUPPORT FOR CONCRETE WALL BRACES

(71) Applicant: Midwest Concrete & Masonry Supply, Inc., Naperville, IL (US)

(72) Inventor: Marinus Hansort, St. Pete Beach, FL (US)

(73) Assignee: CCS CONTRACTOR EQUIPMENT & SUPPLY, LLC, Naperville, IL (US)

( * ) Notice: Subject to any disclaimer, the term of this patent is extended or adjusted under 35 U.S.C. 154(b) by 0 days.

(21) Appl. No.: 16/365,202

(22) Filed: Mar. 26, 2019

(65) Prior Publication Data

US 2019/0301152 A1 Oct. 3, 2019

Related U.S. Application Data

(60) Provisional application No. 62/648,611, filed on Mar. 27, 2018.

(51) Int. Cl.

| | |
|---|---|
| ***E04C 5/16*** | (2006.01) |
| ***E04G 21/26*** | (2006.01) |
| ***E04B 1/18*** | (2006.01) |
| *E04C 3/02* | (2006.01) |
| *E04H 12/20* | (2006.01) |

(52) U.S. Cl.

CPC ..... *E04B 1/185* (2013.01); *E04C 5/16* (2013.01); *E04C 2003/026* (2013.01); *E04G 21/26* (2013.01); *E04H 12/20* (2013.01)

(58) Field of Classification Search

CPC ..... E04G 21/26; E04G 17/14; E04B 1/185; E04C 5/16; E04C 2003/026; E04H 12/20

See application file for complete search history.

(56) References Cited

U.S. PATENT DOCUMENTS

| | | | | |
|---|---|---|---|---|
| 2,511,584 A | | 6/1950 | Hill | |
| 2,687,268 A | | 8/1954 | Hawes | |
| 2,777,660 A | | 1/1957 | Albrecht | |
| 2,832,559 A | * | 4/1958 | Hillberg | E04G 21/26 254/100 |
| 2,945,662 A | | 7/1960 | Jennings | |
| 3,006,592 A | * | 10/1961 | Davis, Jr. | E04G 17/14 248/354.3 |
| 3,154,833 A | | 11/1964 | Kimball | |
| 3,171,627 A | | 3/1965 | Tapley et al. | |
| 3,371,902 A | * | 3/1968 | Hartwick | B62D 37/00 52/157 |

(Continued)

FOREIGN PATENT DOCUMENTS

DE 29919707 U1 2/2000

*Primary Examiner* — Phi D A

(74) *Attorney, Agent, or Firm* — Bodman PLC

(57) ABSTRACT

A ground anchor bracket for supporting at least one wall brace at an earth anchor includes a sleeve that has a wall structure surrounding a hollow interior that is configured to receive a stem of the earth anchor. A platform is coupled with an upper portion of the sleeve and has an upper surface that is configured to support a shoe of a wall brace. A post is coupled with the platform and the post protrudes upward from the upper surface of the platform so as to be configured to engage a slot in the shoe of the wall brace. The upper surface of the platform may be substantially planar to simulate a slab floor surface for engaging the shoe of the wall brace.

20 Claims, 9 Drawing Sheets

(56) References Cited

U.S. PATENT DOCUMENTS 3,504,880 A 4/1970 Toms
3,728,838 A 4/1973 Stout
3,750,349 A * 8/1973 Deike ..... B60P 3/32 52/23
3,788,026 A * 1/1974 Cook ..... E04G 21/26 52/127.2
3,817,006 A * 6/1974 Williams ..... E04G 21/26 52/127.2
3,908,956 A 9/1975 Gates
4,000,592 A 1/1977 Kelly
4,068,427 A 1/1978 Camardo
4,070,833 A 1/1978 Hancock
4,083,156 A * 4/1978 Tye ..... E04G 21/26 248/354.5
4,148,162 A * 4/1979 Goodrich ..... B60S 9/04 52/23
4,223,492 A * 9/1980 St. Clair ..... E02D 5/80 52/157
4,872,634 A 10/1989 Gillaspy et al.
4,880,203 A * 11/1989 Holcomb ..... E04G 11/42 249/24
4,944,123 A * 7/1990 Larrieu ..... E04G 21/26 248/351
5,524,854 A * 6/1996 McSwain ..... E01D 21/00 248/235
5,862,635 A * 1/1999 Linse ..... E04H 9/14 52/126.6
6,263,622 B1 * 7/2001 Griffin ..... E02D 5/801 52/153
6,298,611 B1 10/2001 Oliver et al.
6,347,489 B1 2/2002 Marshall, Jr. et al.
6,505,447 B1 * 1/2003 Oliver ..... E02D 27/01 52/292
6,854,222 B2 * 2/2005 Hansort ..... E04G 21/26 52/127.2
6,871,455 B1 * 3/2005 Cockman ..... E02D 5/801 135/118
6,971,209 B1 * 12/2005 Blevins ..... E02D 5/801 248/156
6,986,495 B2 * 1/2006 Pinkieton ..... E04F 11/00 248/507
8,919,060 B1 12/2014 Oliver et al.
9,206,580 B2 * 12/2015 Oliver ..... E02D 27/01
9,394,717 B2 * 7/2016 Paananen ..... E04H 12/2215
9,556,581 B2 1/2017 Hale et al.
9,631,392 B2 4/2017 Bergman
9,932,718 B2 4/2018 Blevins et al.
10,006,185 B2 * 6/2018 Tomchesson ..... E02D 5/223
2001/0000842 A1 5/2001 MacKarvich
2002/0170253 A1 11/2002 MacKarvich
2003/0190196 A1 10/2003 Lanka
2005/0188627 A1 * 9/2005 Alberts ..... E04F 15/02183 52/166
2006/0096184 A1 5/2006 Kraaijkamp
2006/0179728 A1 8/2006 Lang
2007/0028533 A1 2/2007 Stroyer
2009/0199466 A1 * 8/2009 Rosaen ..... A01G 9/28 47/33
2011/0036026 A1 * 2/2011 Lee ..... E04H 12/2223 52/157
2011/0047895 A1 3/2011 Finch
2012/0031017 A1 2/2012 Stroyer
2012/0304555 A1 12/2012 Oliver et al.
2014/0356076 A1 12/2014 Hale et al.
2014/0366463 A1 12/2014 Oliver et al.
2015/0247336 A1 9/2015 Bergman
2016/0215519 A1 7/2016 Bergman
2017/0226713 A1 8/2017 Blevins et al.
2018/0058082 A1 3/2018 Hansort

* cited by examiner

GROUND ANCHOR BRACKET WITH SIMULATED SLAB SUPPORT FOR CONCRETE WALL BRACES

CROSS REFERENCE TO RELATED APPLICATION

This application claims benefit and priority under 35 U.S.C. § 119(e) to U.S. provisional application Ser. No. 62/648,611, filed Mar. 27, 2018, the disclosure of which is hereby incorporated by reference in its entirety.

TECHNICAL FIELD

This disclosure relates generally to wall braces used to support upright wall panels and forms, such as tilt-up panels, and more particularly relates to ground anchors for such braces.

BACKGROUND

It is generally known to temporarily brace precast concrete structures, such as wall panels or forms or the like, in an upright or vertical orientation with tilt-up wall braces that extend at an angle from the floor or ground to an elevated portion of the wall. For example, prefabricated concrete wall panels may be formed on a flat surface and subsequently lifted or tilted up to an upright or vertical orientation. Tilt-up wall braces commonly include heavy steel poles and/or adjustable length pipe sections that engage the wall panels and may be secured to the floor or ground generally remain in place until additional structural components are secured to the wall, such as a roof structure being installed over the supported or braced walls, thus providing sufficient stability to the building structure to allow the braces to be safely removed.

SUMMARY

The present disclosure provides a ground anchor assembly that uses an anchor bracket to support at least one wall brace at an earth anchor, such as a helical anchor engaged in soil or gravel or the like. The anchor bracket has a base structure that is configured to attach to an end of the earth anchor and may be provided as a sleeve, such as tubular structure, that has a wall surrounding a hollow interior area that receives a stem or outermost portion of the earth anchor. One or more platforms may be attached to or supported at an upper portion of the sleeve, where the platform may have an upper surface configured to support a lower end of a wall brace, such as a shoe disposed at the lower end of the wall brace. A retention member, such as a post, may protrude upward from the upper surface of the platform to engage the lower end of the wall brace, such as a slot in the shoe. The upper surface of the platform may be substantially planar to simulate a slab floor surface for engaging the shoe of the wall brace, such that the lower end of the wall braces may be quickly and efficiently engaged to the ground anchors at the brackets without modification to the shoes or wall braces.

According to one aspect of the present disclosure, a ground anchor bracket for supporting at least one wall brace at an earth anchor includes a sleeve that has a wall structure surrounding a hollow interior that is configured to receive a stem of the earth anchor. A platform is coupled with an upper portion of the sleeve and has an upper surface that is configured to support a shoe of a wall brace. A post is coupled with the platform and the post protrudes upward from the upper surface of the platform so as to be configured to engage a slot in the shoe of the wall brace. The upper surface of the platform may be substantially planar to simulate a slab floor surface for engaging the shoe of the wall brace.

According to another aspect of the present disclosure, a ground anchor bracket for supporting two wall braces at an earth anchor includes a sleeve that is configured to receive a stem of the earth anchor. A pair of platforms may be coupled with an upper portion of the sleeve, where each platform has an upper surface that is configured to support a shoe of one of the wall braces. A retention member may be coupled with each of the pair of platforms that protrudes upward from the upper surface of the respective platform for engaging the shoe of the respective wall brace supported at the upper surface of the platform. The upper surfaces of the platforms may be substantially planar and disposed at an offset angle from each other to angle the supported braces away from each other.

These and other objects, advantages, purposes, and features of the present disclosure will become apparent upon review of the following specification in conjunction with the drawings.

DETAILED DESCRIPTION

Figure 1:
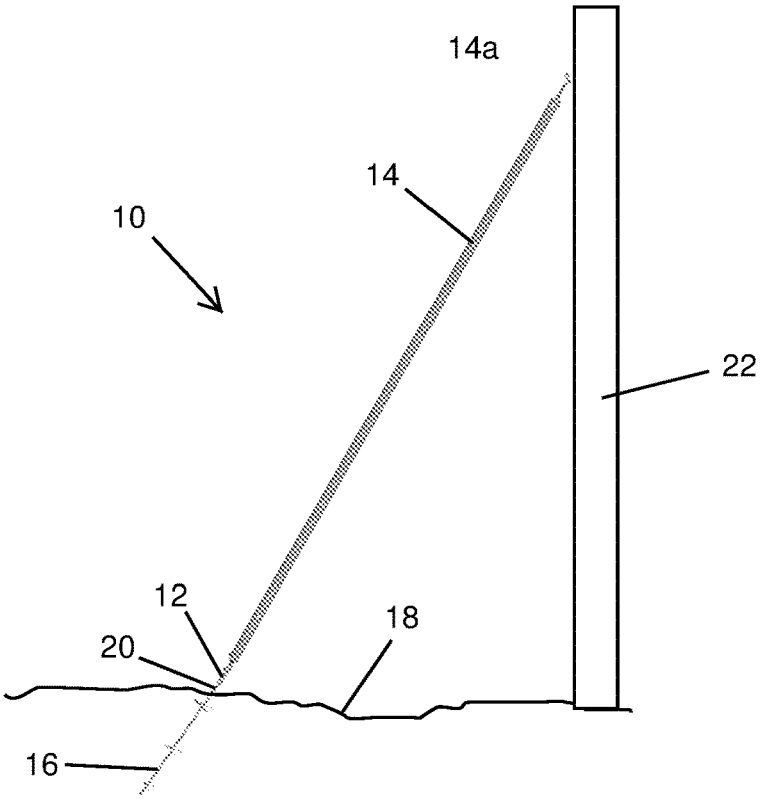
FIG. 1 is a side elevation view of an upright wall panel supported by a wall brace connected to a ground anchor assembly in accordance with the present disclosure.

Referring now to the drawings and the illustrative embodiments depicted therein, a ground anchor assembly 10 may include a ground anchor bracket 12 to support at least one wall brace 14 at a ground anchor, such as a helical anchor 16 that is engaged in soil or gravel or the like. The helical anchor 16 may be driven into the ground 18, such as via rotation, to leave a stem portion 20 of the helical anchor 16 exposed above the ground 18, such as shown in FIG. 1. The stem portion 20 may then be engaged by a ground anchor bracket 12 to provide stable support to a wall brace 14. The ground anchor bracket 12 may be configured to support the wall brace 14 at an angle that extends upward from the helical anchor 16 to brace against an upright structure, such as a wall panel 22 or structure or the like. The wall panel 22 may be formed at least partially with concrete, such as a tilt-up concrete panel or a precast concrete panel or similar wall panel structure. The wall brace 14 functions to maintain the upright or vertical orientation of the wall panel 22 or structure, such as when undergoing forces, such as from wind or other forces expected during a construction operation. Thus, the connection provided by the ground anchor bracket 12 between the wall brace 14 and the helical anchor 16 ensures stable and reliable bracing at ground-based connection points.

Figure 2:
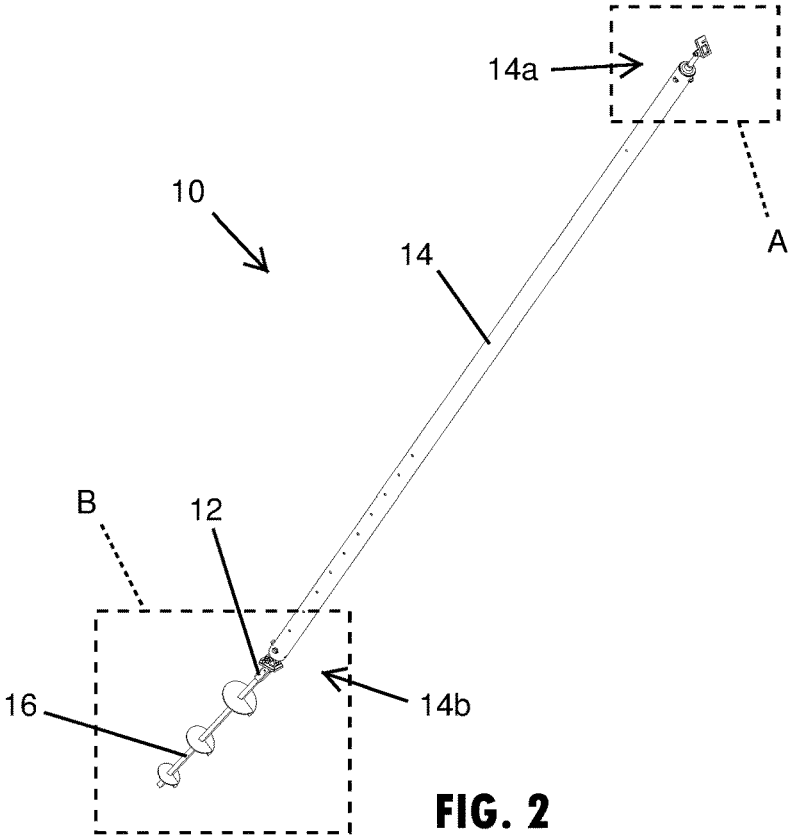
FIG. 2 is a perspective view of the wall brace and attached ground anchor assembly shown in FIG. 1.
Figure 2A:
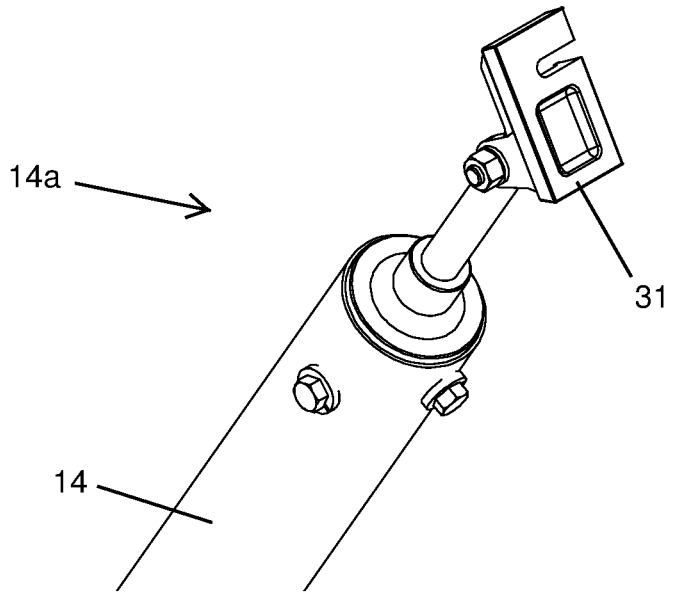
FIG. 2A is an enlarged perspective view of a section of an upper portion the wall brace and a wall connector shown in section A of FIG. 2.
Figure 2B:
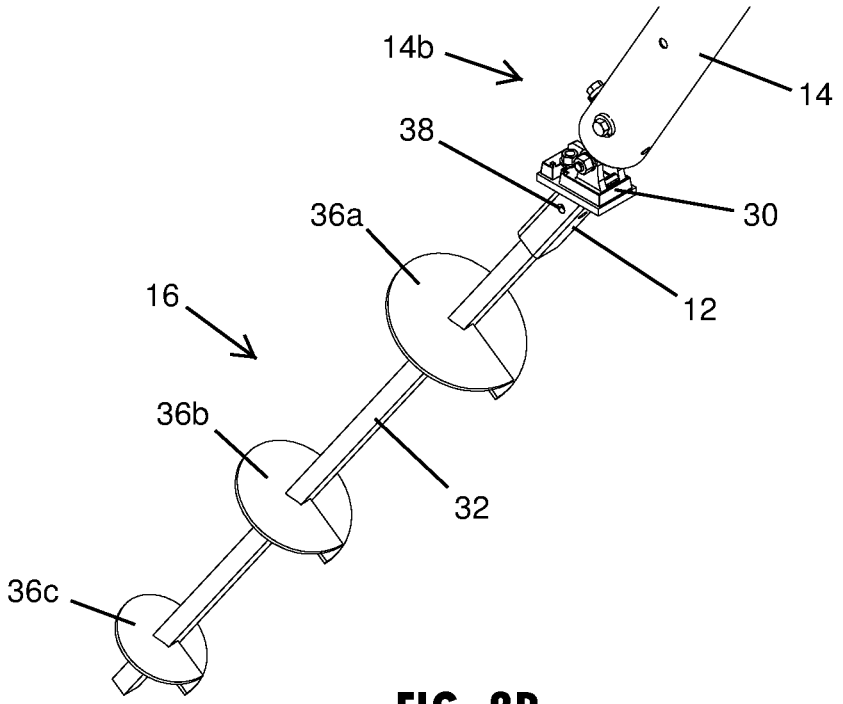
FIG. 2B is an enlarged perspective view of a section of a lower portion the wall brace attached at a ground anchor assembly with a bracket shown in section B of FIG. 2.

The ground anchor bracket 12 has a base structure that attaches to the end of the earth anchor 16 once it is anchored into the ground. The base structure of the anchor bracket 12 may include a sleeve 24 that has a wall structure surrounding a hollow interior area 26 that receives the stem 20 or outermost portion of the helical anchor 16, such as shown in FIG. 2B. Accordingly, the stem 20 of the earth anchor 16 may have a cross-sectional shape that is generally orthogonal, such as a square or rectangular shape, which may be generally continuous along the length of the stem 20. The sleeve 24 of the anchor bracket 12 may engage around the stem 20, whereby the wall structure of the sleeve 24 has a cross-sectional shape that corresponds with the cross-sectional shape of the stem 20, so as to mate the interior surface of the sleeve 24 against the exterior surface of the end of the stem 20. The mated engagement of the orthogonally shaped sleeve 24 with the stem 20 prevents the sleeve 24 from rotating relative to the stem 20.

Figure 3:
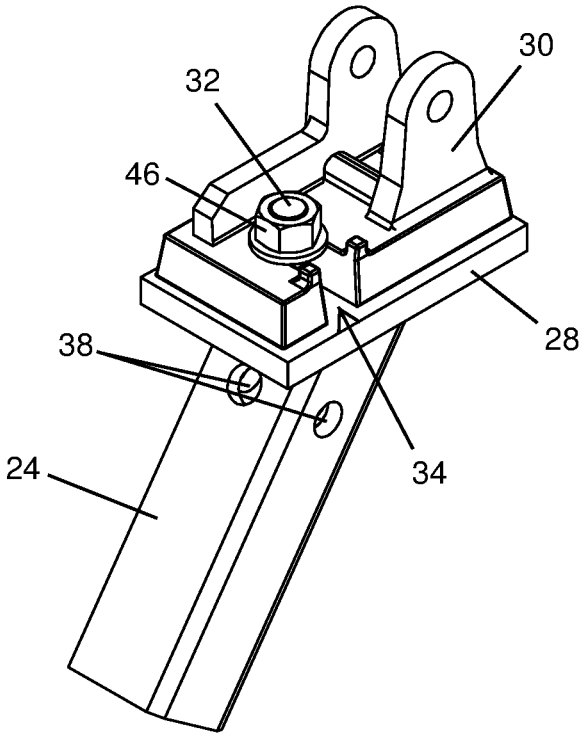
FIG. 3 is a perspective view of the ground anchor bracket shown in FIG. 2B, showing a connection shoe of the brace attached to the bracket.
Figure 4:
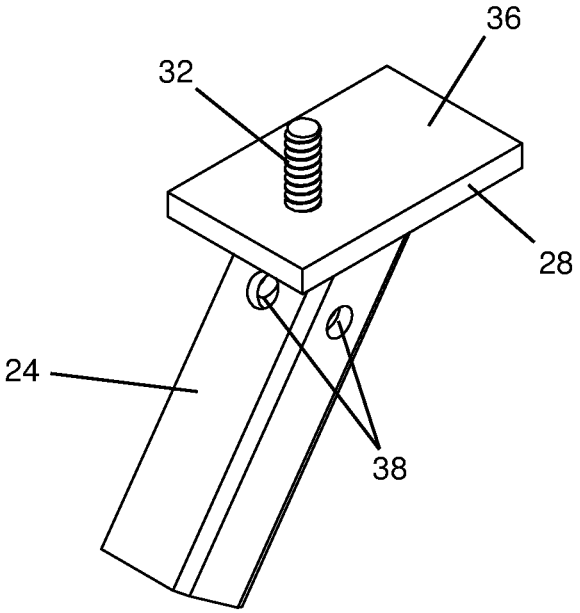
FIG. 4 is a perspective view of the ground anchor bracket shown in FIG. 3 without the connection shoe attached.
Figure 5:
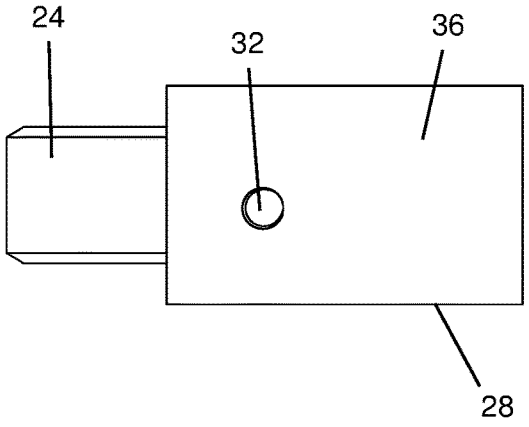
FIG. 5 is a top plan view of the ground anchor bracket shown in FIG. 4.
Figure 6:
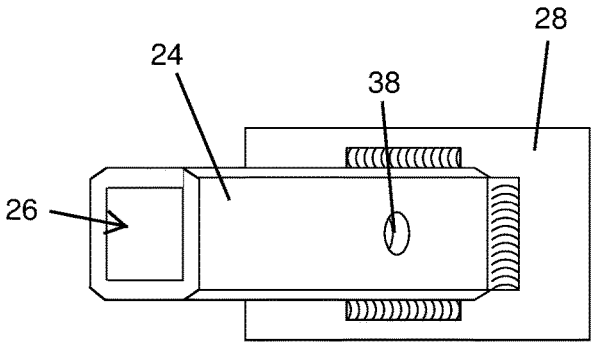
FIG. 6 is a bottom plan view of the ground anchor bracket shown in FIG. 4.

One or more platforms 28 may be attached to or supported at an upper portion of the sleeve 24 for supporting a lower end 14*b* of the wall brace 14. As shown in FIG. 3, the platform may be configured to easily attach and support a shoe 30 that is disposed at the lower end 14*b* of the wall brace 14. A retention member may be provided at the ground anchor bracket 12 to engage the shoe 30 of the wall brace 14. The retention member may include a coil or post 32 that protrudes upward from the platform 28 to engage a slot 34 (FIG. 3) in the shoe 30. Also, an upper surface 36 (FIG. 4) of the platform 28 may be configured to support the underside of the shoe 30 and may be substantially planar to simulate a slab floor surface for engaging a bottom surface of the shoe 30 at the lower end 14*b* of the wall brace 14. In doing so, the shoe at the lower end of the wall brace that is typically used to support the lower end of the wall brace at a slab surface, such as slab floor, may be quickly and efficiently engaged to the ground anchor at the ground anchor brackets 12 without modification or removal of the shoe.

With reference to FIG. 1, the wall brace 14 may extend at an angle from the ground 18 to an elevated portion of the wall panel 22 to temporarily support the wall panel 22 in a desired upright or vertical position, such as during construction of an associated building or structure or the like. The wall brace 14 may extend generally linearly between its upper and lower ends 14*a*, 14*b* to provide direct supportive load paths. The wall brace 14 may include a single metal pole or pipe or multiple engaged metal poles or pipes, such as adjustable length pipe sections that use removable shear pins to adjust the brace to the desired length. As shown in FIG. 2, the wall brace 14 is provided as a length adjustable pipe section. The upper end 14*a* of the wall brace 14 may be attached at or temporarily fixed to the wall panel 22, such as with fasteners, anchors, or the like to secure the upper end 14*a* of the wall brace 14 before or after lifting and positioning the wall panels and before or after securing or attaching the lower end 14*b* of the wall brace 14 to the floor or ground anchor assembly 10. As shown in FIG. 2A, the upper end 14*a* of the wall brace 14 may also include a shoe 31, such as the same or similar configuration to the shoe 30 (FIG. 3) at the lower end 14*b* of the wall brace 14.

Before securing or engaging the lower end 14*b* of the wall brace 14 to the ground anchor assembly 10, the ground anchor, such as the helical anchor 16 shown in FIG. 3, may have a lower portion that is driven into or otherwise anchored into the earth or ground. The lower portion of the anchor 16 may include an elongated shank 32, such as shown in FIG. 2B, which may be surrounded by a helical threaded portion 34, such as a spiral or auger shaped member that helically extends around at least a portion of the shank 32. The helical anchor 16, as further shown in FIG. 2B, may have separate sections 36*a*, 36*b*, 36*c* of the helical threaded portion 34 spaced along the elongated shank 32. It is contemplated that each section of the helical threaded portion may be configured differently from the illustrated embodiments, such as with different thread angles, to engage at various depths of ground, such as ground that has different soil compressions and/or types. It is also understood that the helical threaded portion may be formed continuously along the shank portion and/or formed in various shapes or thread patterns from the illustrated embodiments to securely engage the ground and prevent withdrawal from the ground, such as due to forces acting on the wall panel.

Figure 7:
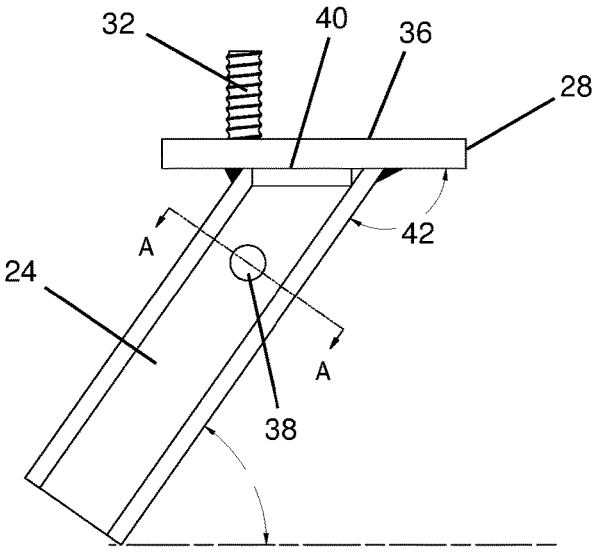
FIG. 7 is a side elevation view of the ground anchor bracket shown in FIG. 4.
Figure 8:
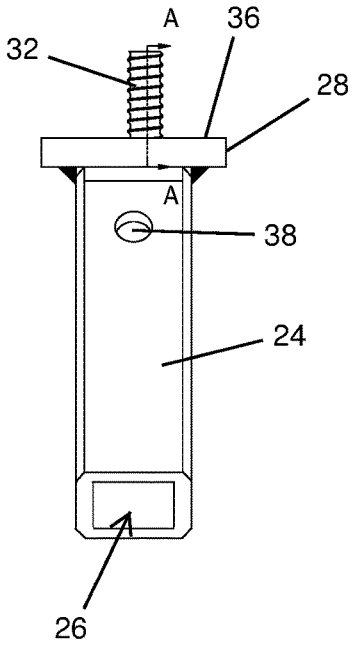
FIG. 8 is another side elevation view of the ground anchor bracket shown in FIG. 4.

The ground anchor bracket 12 may attach to the upper portion or stem portion of the helical anchor 16 by engaging the sleeve 24 over the stem portion, such that the stem portion extends into the hollow interior area 26 of the sleeve 24, such as shown in FIG. 2B. The ground anchor bracket 12 may have a wall structure with a generally consistent wall thickness disposed around the hollow interior area 26 of the sleeve 24 that may be disposed generally centrally through the sleeve 24, such as to provide a tubular shape. It is also contemplated that the wall structure of the sleeve may be formed with multiple pieces, such as shown in FIG. 7B, where four individual plates are welded at corners 25*a* to form a sleeve 24*a* that surrounds a hollow interior area 26*a* for engaging the anchor stem.

Figure 7A:
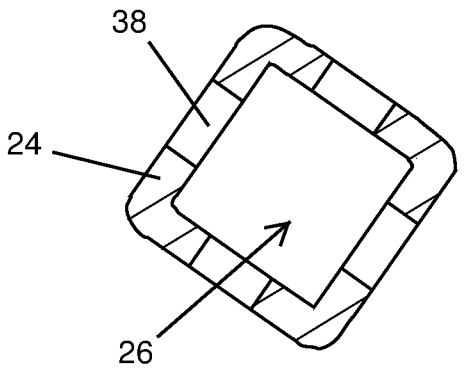
FIG. 7A is a cross-sectional view of the ground anchor bracket, taken at line A-A shown in FIG. 7.
Figure 7B:
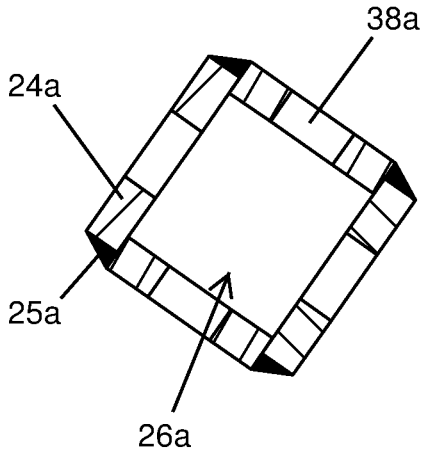
FIG. 7B is a cross-sectional view of an additional embodiment of a ground anchor bracket, showing four plates welded at corners to form a sleeve for engaging the anchor stem.

Also, the sleeve 24 may have a non-circular cross sectional shape to prevent rotation of the sleeve 24 on the helical anchor 16, such as a polygonal shaped or orthogonally shaped or a substantially rectangular or square shaped cross-section, as shown in FIG. 7A. The wall structure of the sleeve 24 may be shaped to correspond with the shape of the upper portion of the elongated shank of the helical anchor 16 for matably attaching or engaging the sleeve 24 to the helical anchor 16. Thus, as shown in FIG. 2B, the sleeve 24 may have a generally square cross-sectional shape to corresponds with the generally square cross-sectional shape of the upper portion of the helical anchor 16. It is understood that various mated cross-sectional shapes may be provided at the interface of the ground anchor bracket and the ground anchor in additional embodiments.

To secure the sleeve 24 to the helical anchor 16, the ground anchor bracket 12 may have openings 38 in sides of the wall structure of the sleeve 24 that may align with each other through the sleeve 24. These openings 38 may be aligned with openings in the upper portion of the helical anchor 16, such that the aligned openings may receive a fastener, such as a cotter pin or lock pin or bolt or the like, that is disposed through the helical anchor 16 and the openings 38, such to provide a secure connection between the ground anchor bracket 12 and the anchor 16. It is also contemplated that the ground anchor bracket 12 may be integrally formed with the earth anchor 16, such that the platforms 28 and retention members for engaging and supporting the shoe or shoes of the wall brace or braces, may be formed or attached directly to the stem of the earth anchor.

The platform 28 attached to or supported at an upper portion of the sleeve 24, such as shown in FIGS. 1 and 7, may be positioned to horizontally orient or otherwise generally align the upper surface 36 of the platform 28 with a planar extent of the ground surface 18. As also shown in FIG. 7, the upper surface 36 of the platform 28 may be substantially planar to simulate a slab floor surface for engaging the shoe 30 of the wall brace 14. The upper portion of the wall structure of the sleeve 24, as shown in FIG. 7, may include an upper edge 40 that is disposed around the sleeve 24 in a plane that is oriented at an offset angle 42 from the linear extent of the sleeve 24 or a central axis surrounded by the wall structure of the sleeve 24. The offset angle 42 of the plane disposed at the upper edge of the sleeve may be at or between 110° and 135° or between 115° and 130° or approximately 125°. As shown in FIGS. 1-8, the upper edge 40 may attached at a lower surface of the platform 28. Thus the offset angle 42 may be configured to horizontally orient the upper surface 36 of the platform 28 when the elongated shank 32 of the ground anchor 16 is angled at approximately 55° when engaged in the ground. This angle of the ground anchor may vary by at least 20° but it is contemplated that the wall brace 14 is substantially aligned with the angle of the ground anchor 16 to efficiently hold and brace under load conditions.

Figure 8A:
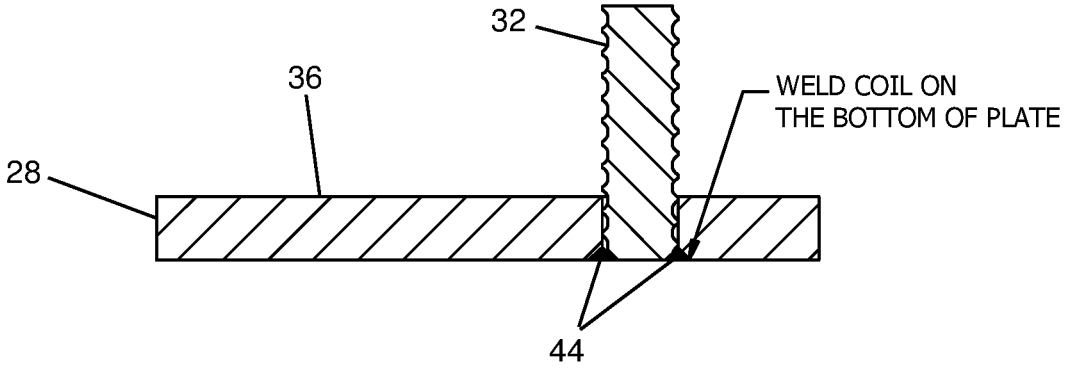
FIG. 8A is a cross-sectional view of the ground anchor bracket, taken at line A-A shown in FIG. 8.
Figure 9:
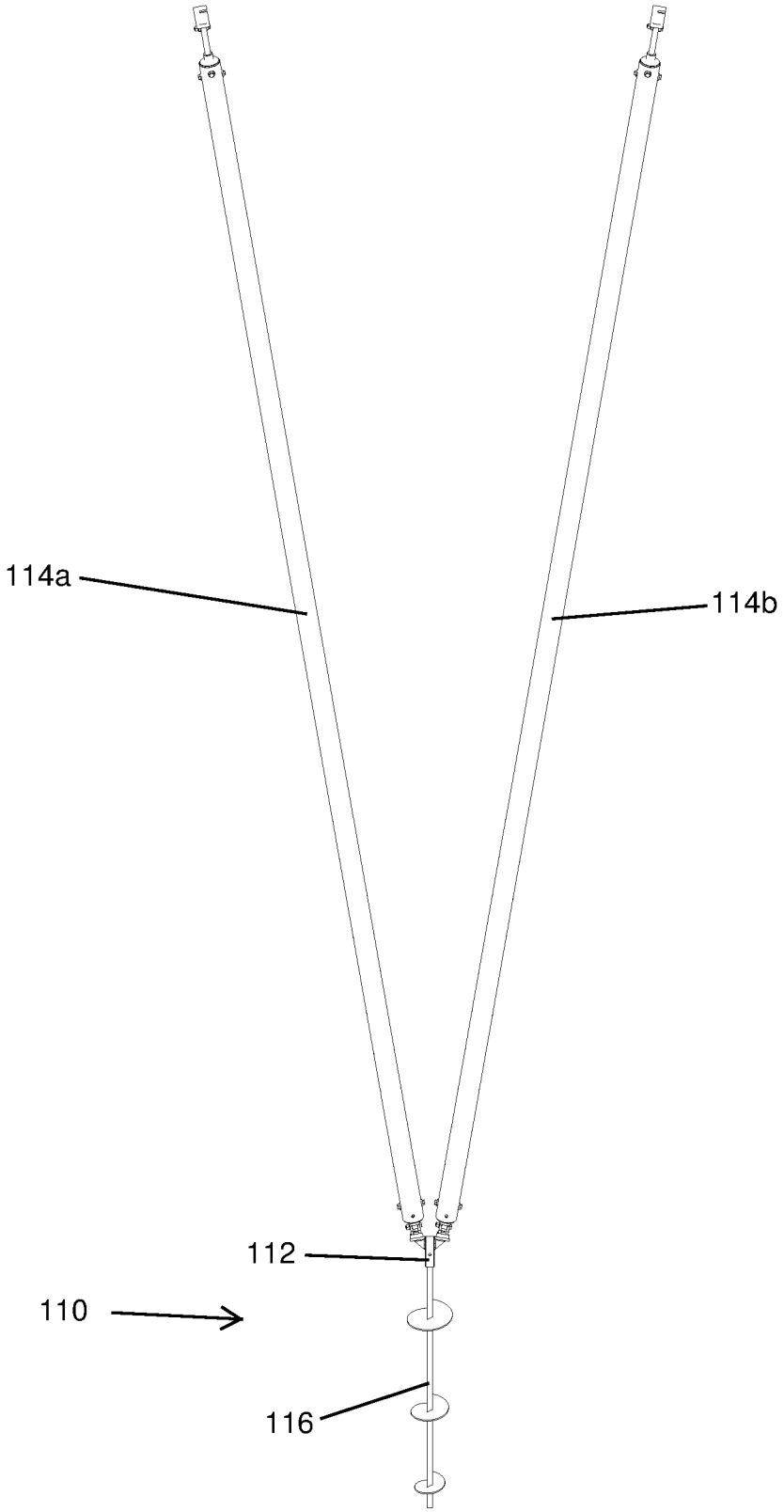
FIG. 9 is a side elevation view of two wall braces connected to an additional embodiment of a ground anchor assembly in accordance with the present disclosure.

With the bottom surface of the shoe 30 engaged with and/or supported at the upper surface 36 of the platform 28, the shoe 30 may be further supported with a retention member, such as a coil or post 32. The post 32 shown in FIGS. 7 and 8 protrudes upward from the platform 28 upright and substantially orthogonal to the planar extent of the upper surface 36 of the platform 28. To hold the coil or post 32 at the platform, the coil or post 32 may be inserted within a vertical opening in the platform 28 and a connection 44 may be formed between the platform 28 and the post 32, such as with welding as shown in FIG. 8A or other connections, such as threadably attaching or adhesive or the like. The coil or post 32 may be disposed on the platform 28 in a location that engages the slot 34 in the shoe 30, such as shown in FIG. 3. Further, the post may 32 have a threaded outer surface that is configured to threadably engage a nut 46 that clamps of the shoe 30 at the lower end 14*b* of the wall brace 14 against the upper surface 36 of the platform 28, as shown in FIG. 3.

Figure 13:
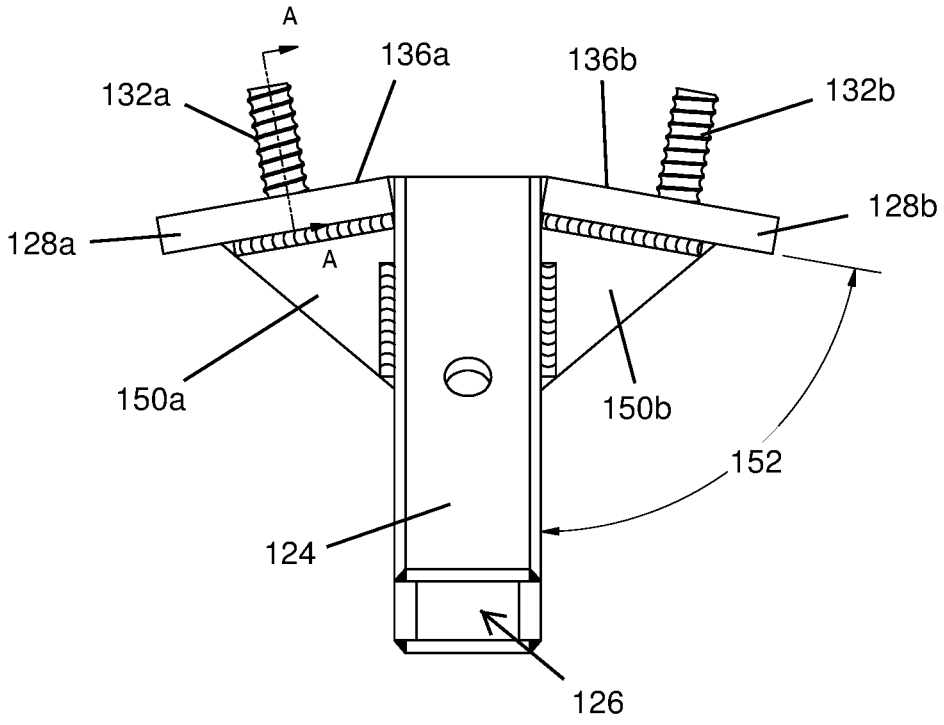
FIG. 13 is a side elevation view of the ground anchor bracket shown in FIG. 11.
Figure 13A:
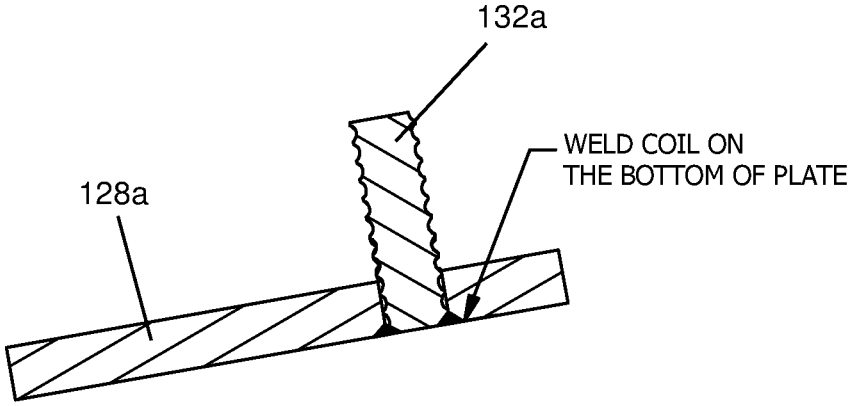
FIG. 13A is a cross-sectional view of the ground anchor bracket, taken at line A-A shown in FIG. 13.
Figure 14:
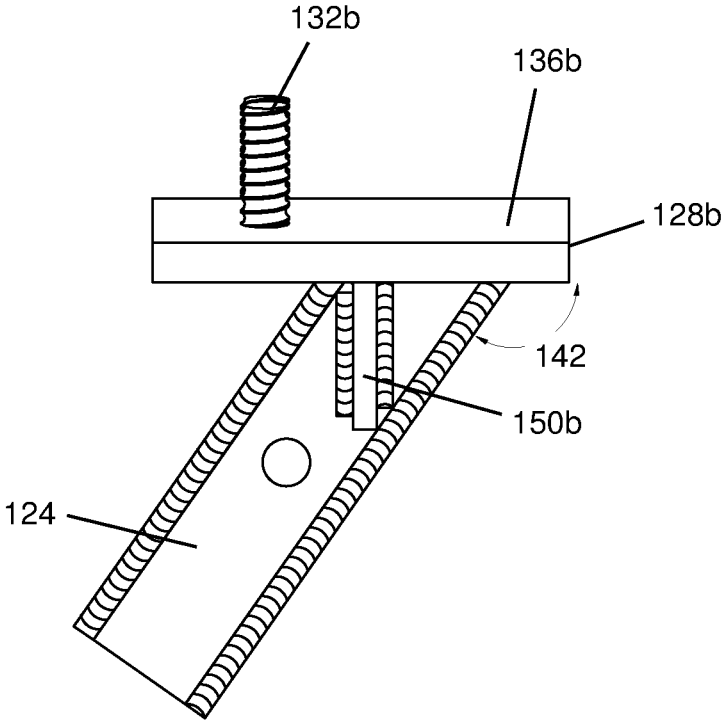
FIG. 14 is a side elevation view of the ground anchor bracket shown in FIG. 11.

Referring now to FIGS. 9-14, an additional embodiment of the ground anchor bracket 112 is provided that supports two wall braces 114*a*, 114*b* at a single ground anchor 116. The ground anchor bracket 112 has a sleeve 124 that receives a stem or upper portion of the anchor 116. The sleeve 124 has a wall structure with a generally consistent wall thickness disposed around the hollow interior area 126 of the sleeve 124, which is disposed generally centrally through the sleeve 124. Similar to the embodiment shown in FIG. 7B, the sleeve 124 shown in FIG. 14 is formed with multiple pieces or plates, where four individual plates are welded at corners 125 of the sleeve 124 to surround the hollow interior area 126 that receives the anchor stem. It is also contemplated that the sleeve used for supporting multiple wall braces may a tubular construction without welded corners or other conceivable sleeve configuration. Thus, the ground anchor bracket 112 may also have a non-circular cross sectional shape that mates with the upper portion of the helical anchor 116 to prevent rotation of the sleeve 124 on the helical anchor 116, such as the substantially square shaped cross-section shown in FIG. 11.

Figure 10:
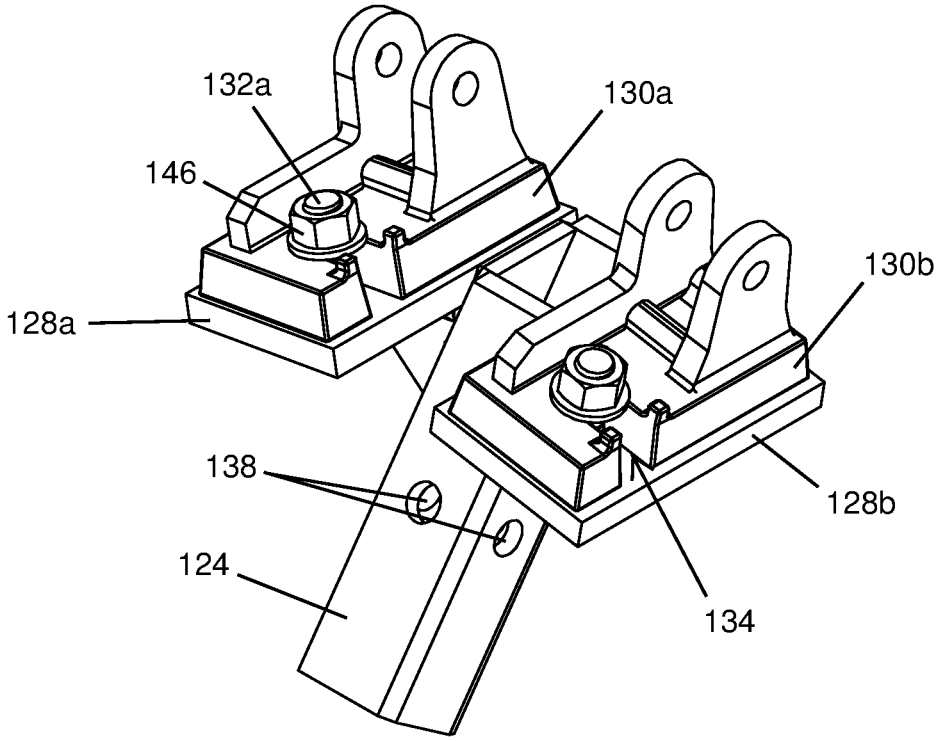
FIG. 10 is a perspective view of the ground anchor bracket shown in FIG. 9, showing the connection shoes of the braces attached to the bracket.
Figure 11:
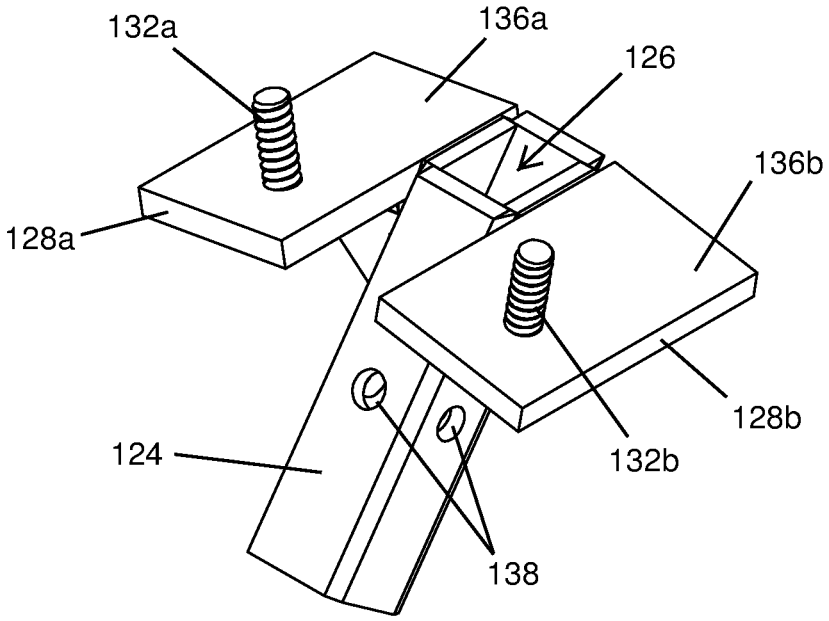
FIG. 11 is a perspective view of the ground anchor bracket shown in FIG. 10 without the connection shoes attached.
Figure 12:
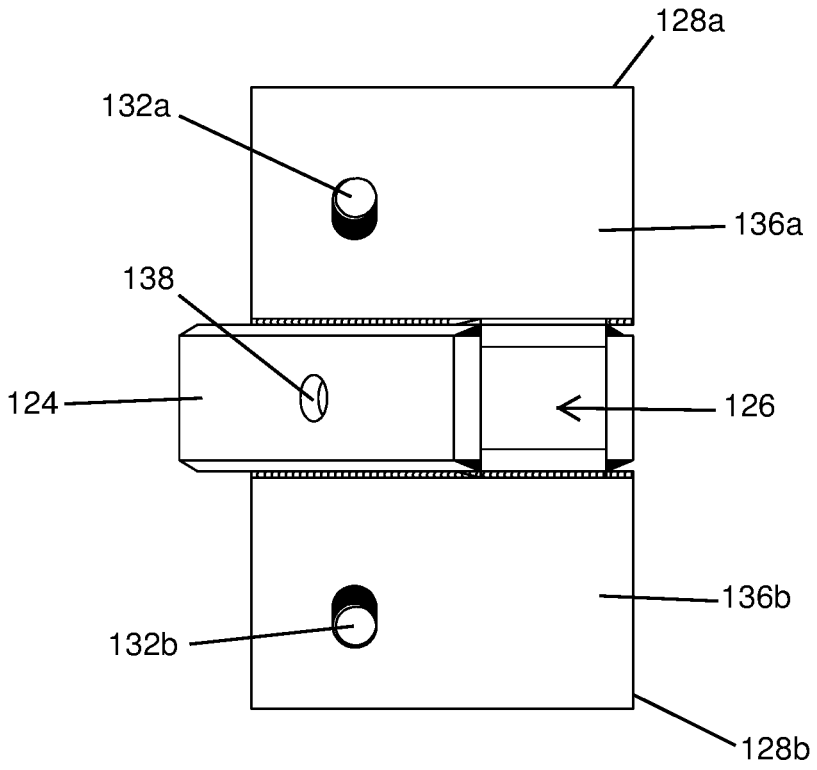
FIG. 12 is a top plan view of the ground anchor bracket shown in FIG. 11.

The ground anchor bracket 112 may have a platform to support each wall brace, such as a pair of platforms 128*a*, 128*b* attached to or supported at an upper portion of the sleeve 124 as shown in FIG. 10. Each platform 128*a*, 128*b* supports a shoe 130*a*, 130*b* that is disposed at the lower end of the respective wall brace 114*a*, 114*b*. A retention member, such as a coil or post 132*a*, 132*b*, may protrude upward from the respective platform 128*a*, 128*b* to engage a slot 134 in the respective shoe 130*a*, 130*b*, as shown in FIG. 10. Also, an upper surface 136*a*, 136*b* of each platform 128*a*, 128*b* may be substantially planar to simulate a slab floor surface for engaging a bottom surface of the shoe 130*a*. 130*b* at the respective wall brace 114*a*, 114*b*.

The platform 128*a*, 18*b* attached to or supported at an upper portion of the sleeve 124, such as shown in FIGS. 11-14, may be positioned at laterally offset locations from the center of the sleeve 124, such as shown on opposing sides of the sleeve 124. As shown in FIG. 13, a bracket 150*a*, 150*b* may be attached at an outer surface of the sleeve 124 and at a lower surface of the respective platform 128*a*, 128*b* to support the platform at a laterally offset position from the sleeve 124. The brackets 150*a*, 150*b* may also orient the upper surfaces 136*a*, 136*b* of the platforms 128*a*, 128*b* at an angle away from the sleeve to angle the wall braces 114*a*, 114*b* away from each other, such as to support separate wall panels or the like. As shown in FIG. 13, the angle 152 between the respective platform and the sleeve that provides such separation of the wall braces 114*a*, 114*b* is approximately between 45° and 80° or approximately 55°.

As also shown in FIG. 14, the upper surfaces 136*a*, 136*b* of the platform 28 may be substantially planar to simulate a slab floor surface for engaging the respective shoe 130*a*, 130*b* of the wall brace 114*a*, 114*b*. The upper surfaces 136*a*, 136*b* may thus extend substantially horizontally toward and away from the supported wall panel. Accordingly, the offset angle 142 shown in FIG. 14 may be at or between 110° and 135° or between 115° and 130° or approximately 125°. The offset angle 142 may be configured to provide the illustrated orientation of the upper surfaces 136*a*, 136*b* of the platforms 128*a*, 128*b* when the elongated shank 132 of the ground anchor 116 is angled at approximately 55° when engaged in the ground, such that the wall braces when viewed from the side may be substantially aligned with the angle of the ground anchor 116 engaged in the ground to efficiently hold and brace under load conditions.

It is to be understood that the specific devices and processes illustrated in the attached drawings, and described in this specification are simply exemplary embodiments of the inventive concepts defined in the appended claims. Hence, specific values and other precise physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A bracing assembly for bracing a wall with an earth anchor, the bracing assembly comprising:

a wall brace having an elongated tubular member, an upper shoe pivotally coupled at an upper end of the elongated tubular member for engaging the wall, and a lower shoe pivotally coupled at a lower end of the elongated tubular member; and a ground anchor bracket comprising:

a base sleeve having a tubular wall surrounding a hollow interior that is configured to receive a stem of the earth anchor, the tubular wall having a aperture configured to receive a fastener that temporarily engages the stem;

a platform fixed at an upper portion of the base sleeve, the platform having an upper surface that is planar and interfaces with a bottom surface of the lower shoe of the wall brace; and a retention member coupled with the platform, the retention member protruding upward from the upper surface of the platform and through the opening in the lower shoe of the wall brace to retain the lower shoe at the platform, wherein the base sleeve is disposed at an angle relative to the upper surface of the platform, the upper surface of the platform is configured, the upper surface of the platform is configured to stimulate a slab floor surface when the ground anchor bracket is temporarily engaged to the earth anchor.

2. The bracing assembly of claim 1, wherein the wall structure of the base sleeve comprises an orthogonal cross-sectional shape.

3. The bracing assembly of claim 2, wherein the angle of the base sleeve relative to the upper surface of the platform is defined from a central axis of the base sleeve that is surrounded by the tubular wall.

4. The bracing assembly of claim 3, wherein the angle of the base sleeve relative to the upper surface of the platform is at or between 110° and 135°.

5. The bracing assembly of claim 2, further comprising a support bracket attached at an outer surface of the tubular wall and a lower surface of the platform to support the platform at a laterally offset position from the base sleeve.

6. The bracing assembly of claim 1, wherein the retention member comprises a post that protrudes upward from a central area of the upper surface.

7. The bracing assembly of claim 6, wherein the post is fixed to the platform and protrudes orthogonally relative to the upper surface of the platform.

8. The bracing assembly of claim 6, wherein the post comprises a threaded outer surface configured to threadably engage a nut that clamps the lower shoe of the wall brace against the upper surface of the platform.

9. The bracing assembly of claim 8, wherein the the threaded outer surface of the post extends from the upper surface of the platform to a top end of the post.

10. The bracing assembly of claim 1, wherein the base sleeve comprises four plates welded together at edges to form orthogonal corners of the base sleeve.

11. A bracing assembly for bracing a wall with an earth ancho, the bracing assembly comprising:

a first wall brace having an elongated tubular member, an upper shoe pivotally coupled at an upper end of the elongated tubular member for engaging the wall, and a lower shoe pivotally coupled at a lower end of the elongated tubular member;

a second wall brace having an elongated tubular member, an upper shoe pivotally coupled at an upper end of the elongated tubular member for engaging the wall, and a lower shoe pivotally coupled at a lower end of the elongated tubular member, and a ground anchor bracket comprising:

a sleeve configured to receive a stem of the earth anchor;

first and second platforms attached at opposing sides of an upper portion of the sleeve, the first platform having an upper surface that is operable to support the lower show of the first wall brace, the second platform having an upper surface that is operable to support the lower show of the second wall brace; and a retention member protruding upward from the upper surfaces of each of the first and second platforms and through openings in the lower shoes to retain the lower shoes at a respective platform.

12. The bracing assembly of claim 11, wherein the upper surfaces of the pair of platforms are planar and interface with bottom surfaces of the lower shoes.

13. The bracing assembly of claim 11, wherein the upper surfaces of the first and second platforms are angled away from each other.

14. The bracing assembly of claim 13, wherein the upper surfaces of the first and second platforms are disposed at an offset angle from a central axis of the sleeve.

15. The bracing assembly of claim 14, wherein the offset angle is at or between 110° and 135°.

16. The bracing assembly of claim 11, further comprising a pair of support brackets that are attached at an outer surface of the sleeve and a lower surface of the first and second platforms to support the first and second platforms at the opposing sides of the sleeve.

17. The bracing assembly of claim 11, wherein the retention members each comprise a post having a threaded outer surface, and wherein the lower shoes each include a slot engaged by the post.

18. A bracing assembly for bracing a wall with an earth anchor, the bracing assembly comprising:

A wall brace having an elongated tubular member, an upper show pivotally coupled at an upper end of the elongated tubular member for engaging the wall, and a lower shoe pivotally coupled at a lower end of the elongated tubular member; and a ground anchor bracket comprising:

a sleeve having a tubular wall structure that surrounds a hollow interior that is configured to receive a stem of the earth anchor with a corresponding cross-sectional shape;

a platform coupled with an upper portion of the sleeve, wherein the platform comprises an upper surface that is substantially planar and oriented at an offset angle from a central axis the sleeve; and a retention member coupled with the platform, wherein the retention member engages an opening in the lower shoe of the wall brace that is supported at the upper surface of the platform.

19. The bracing assembly of claim 18, wherein the retention member comprises a post that is fixed at and protrudes upward from the upper surface of the platform, and wherein the post comprises a threaded outer surface that is configured to threadably engage a nut that clamps the lower shoe of the wall brace against the upper surface of the platform.

20. The bracing assembly of claim 18, wherein the tubular wall structure of the sleeve comprises an orthogonal cross-sectional shape.

* * * * *